US010626661B2

(12) United States Patent
Miller

(10) Patent No.: US 10,626,661 B2
(45) Date of Patent: Apr. 21, 2020

(54) LARGE BOLLARD MOLDED POST DOORS

(71) Applicant: Peter Miller, Wauconda, IL (US)

(72) Inventor: Peter Miller, Wauconda, IL (US)

( * ) Notice: Subject to any disclaimer, the term of this patent is extended or adjusted under 35 U.S.C. 154(b) by 0 days.

(21) Appl. No.: 16/435,207

(22) Filed: Jun. 7, 2019

(65) Prior Publication Data

US 2019/0292840 A1 Sep. 26, 2019

Related U.S. Application Data

(63) Continuation-in-part of application No. 15/928,095, filed on Mar. 22, 2018.

(51) Int. Cl.

*E06B 3/34* (2006.01)
*E05D 7/06* (2006.01)
*E06B 3/70* (2006.01)

(52) U.S. Cl.

CPC ..... *E06B 3/341* (2013.01); *E05D 7/06* (2013.01); *E06B 3/7001* (2013.01); *E06B 3/7015* (2013.01); *E05Y 2900/40* (2013.01); *E06B 2003/7023* (2013.01)

(58) Field of Classification Search

CPC ..... E05D 7/06; E05D 11/04; E05D 2011/045; E05D 15/48; E05D 2015/487; E05F 1/061; E05F 1/068; E05F 13/06; E06B 3/341; E06B 3/7001; E06B 11/04; E04H 2017/1473; E05Y 2900/40

USPC ..... 49/236, 398

See application file for complete search history.

(56) References Cited

U.S. PATENT DOCUMENTS 610,820 A * 9/1898 Nehr ..... E05D 11/04 16/276
1,540,490 A * 6/1925 Mertel ..... E06B 11/04 49/381
4,945,606 A * 8/1990 Eckel ..... E05F 1/065 16/250
5,373,664 A * 12/1994 Butler ..... E01F 13/06 49/25
6,161,363 A * 12/2000 Herbst ..... E06B 3/7001 160/371
6,719,276 B1 * 4/2004 Bush ..... E04H 17/16 256/1
7,506,860 B2 * 3/2009 Stull ..... E06B 11/04 256/26
7,603,965 B1 * 10/2009 Betts ..... A01K 3/00 119/516
7,958,675 B2 * 6/2011 Stull ..... E06B 11/02 256/73
2008/0237561 A1 * 10/2008 Cozby ..... E04H 17/1413 256/73
2010/0255227 A1 * 10/2010 Hisle ..... B44C 5/04 428/34.1
2014/0283337 A1 * 9/2014 Triebold ..... E05D 7/00 16/224
2015/0191955 A1 * 7/2015 Dudley ..... E05F 3/08 49/333

(Continued)

FOREIGN PATENT DOCUMENTS

FR 2977615 A3 * 1/2013 ..... E04H 17/1404
GB 746075 A * 3/1956 ..... E06B 11/04

*Primary Examiner* — Christine T Cajilig
(74) *Attorney, Agent, or Firm* — Gregory B. Gulliver

(57) ABSTRACT

A bollard that supports a door with a top bearing, middle bearing and bottom bearing with the middle and bottom bearing offset from the bollard and a rigid structure molded in the door.

10 Claims, 7 Drawing Sheets

(56) References Cited

U.S. PATENT DOCUMENTS

2017/0074015 A1* 3/2017 Batchelor ..... E05D 7/12

* cited by examiner

LARGE BOLLARD MOLDED POST DOORS

RELATED APPLICATION

This application is a continuation-in-part of U.S. patent application Ser. No. 15/928,095, titled, "Large Bollard Post Doors," by Peter Miller filed on Mar. 22, 2018, which priority is claimed and is incorporated by reference herein.

BACKGROUND OF THE INVENTION

Field of the Invention

This invention relates generally to bollard mounted doors, and more particularly to large external molded bollard mounted doors.

Related Art

In use today are large doors or gates that are mounted on bollards, or in simple terms posts. For small doors, the strength of the post and mounting are typically sufficient to maintain the door in a level position over time. But with large doors, a problem exists with the doors sagging due to the weight of the door. The sagging doors result in premature door failure or bollard failure. Further, bollard failure also occurs due to weathering of the exposed bollard (rust, wear, and abuse). Additionally, the doors often corrode and fail.

There have been attempts to correct these problems, such as adding support to the bottom of doors or even wheels. The problem with such approaches is an increase in materials, expense, and points of failures occur. Attempts have also been made to make lighter doors and protect the doors from corrosion, but similarly, have failed. Therefore, there is a need for methods and systems for maintaining the operational state of a large bollard door while protecting the bollard and door.

SUMMARY

Systems and methods consistent with the present invention provide an approach for fabricating and installing large bollard doors and their associated bollard such that the door's position moves in the vertical plane in addition to the horizontal plane as the door is opened and closed. Further, the door protects the bollard and supporting rigid structure from the environment by covering the rigid support and most of the bollard while being able to rotate on the bollard with maintenance-free bearings.

Other methods, features, and advantages of the invention will be or will become apparent to one with skill in the art upon examination of the following figures and detailed description. It is intended that all such additional methods, features, and advantages be included within this description, be within the scope of the invention, and be protected by the accompanying claims.

BRIEF DESCRIPTION OF THE FIGURES

The components in the figures are not necessarily to scale, emphasis instead being placed upon illustrating the principles of the invention. In the figures, like reference numerals designate corresponding parts throughout the different views.

DETAILED DESCRIPTION

A bollard door support is described with multiple bearings that assist with preventing the door or gate from sagging while protecting the top of the bollard.

Figure 1:
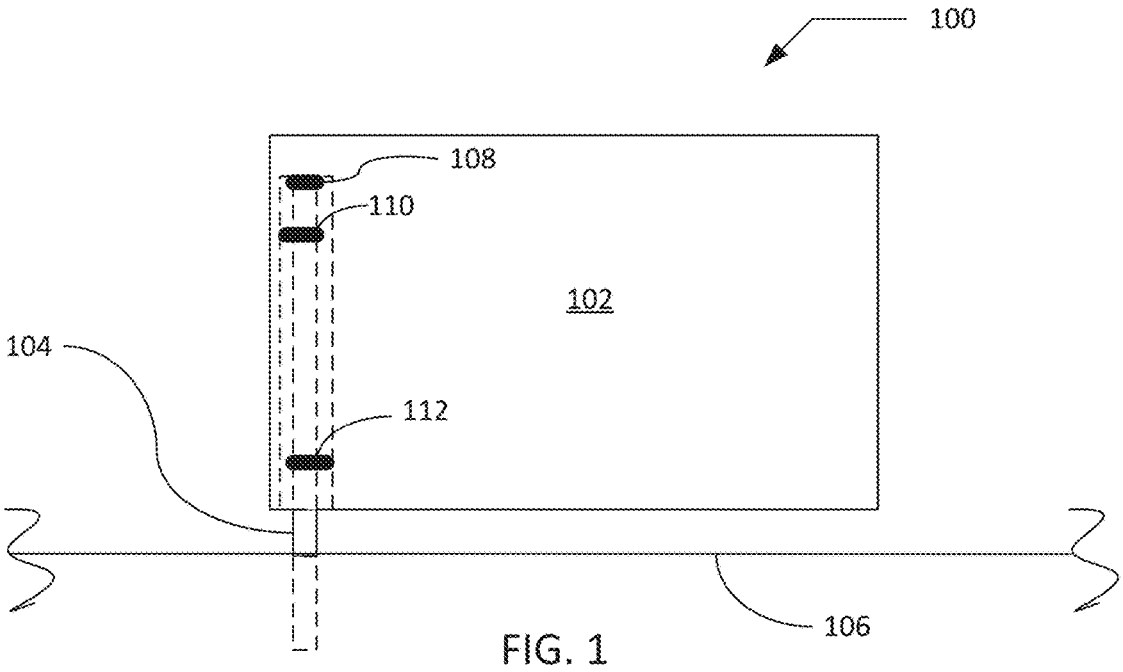
FIG. 1 illustrates a bollard and door in accordance with an example implementation of the invention.

Turning first to FIG. 1, an illustration 100 a bollard 104 and door (or gate) 102 is depicted in accordance with an example implementation of the invention. The bollard 104 may be hollow, hollow with fill, or made up of sections. The bollard 104 must be strong enough to support the door 102 without moving. The bollard 104 support may come from embedding part of the bollard 104 in the ground 106, such as a hole formed from concrete. In other implementations, brackets secured to the ground or combination of bracket and hole may be used to support the bollard 104. The bollard 104 may support or have a plurality of bearings (108, 110 and 112) or devices that allow the door 102 to swing or otherwise move when the door 102 is placed over the bollard 104.

Figure 2:
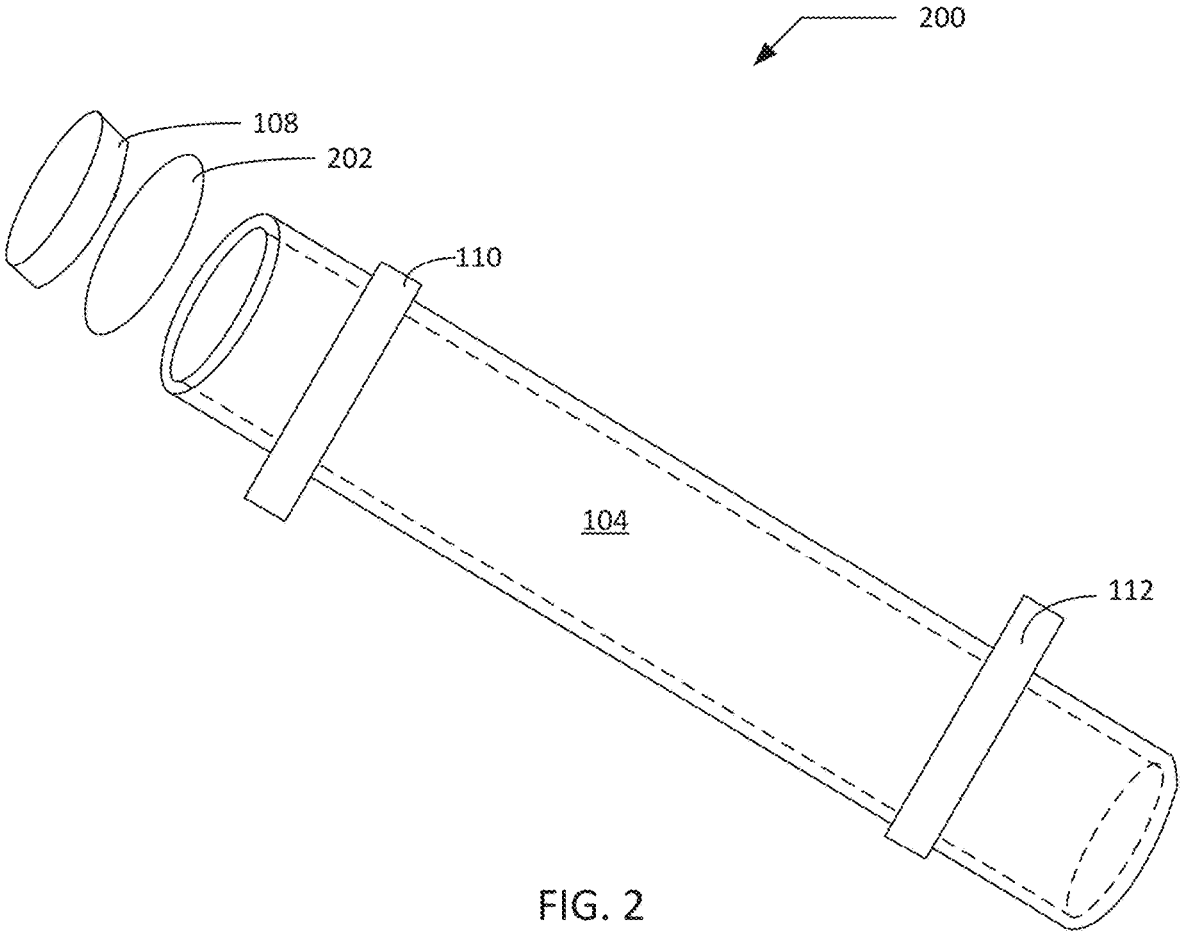
FIG. 2 illustrates the components of the bollard of FIG. 1 in accordance with an example implementation of the invention.

In FIG. 2, the components 200 of the bollard 104 of FIG. 1 are illustrated in accordance with an example implementation of the invention. The bollard 104 is shown with a top 202. The bollard 104 is typically made out of steel as it is stronger and holds up to the elements better than iron. But, in other implementations, other materials such as, for example, composite material or aluminum may be employed. A top bearing 108 is set on the top 202 and supports the movement of the door (102 of FIG. 1). An example of bearing beyond the traditional roller bearing includes a disc (may be of another shape) that has a low coefficient of friction that enables the door 102 to turn on the top bearing 108. An example of such material is phelonic plastic manufactured by GENERAL ELECTRIC (GE). The bearing rings 110 and 112 are made of similar low friction material and may be supported or attached to the bollard 104. The ring bearing (upper bearing 110) and (lower bearing) 112 then support or help support the door 102.

Figure 3:
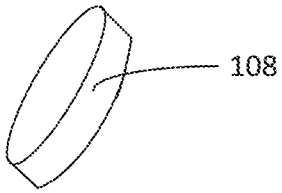
FIG. 3 illustrates a top bearing of the bollard of FIG. 2 in accordance with an example implementation of the invention.
Figure 4:
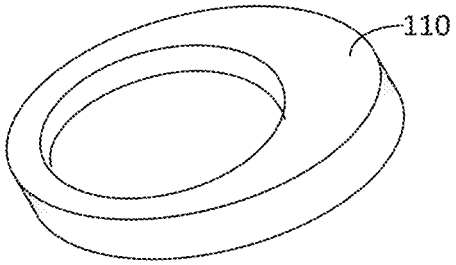
FIG. 4 illustrates a middle bearing of the bollard of FIG. 2 in accordance with an example implementation of the invention.

Turning to FIG. 3, a top bearing 108 of the bollard 104 of FIG. 2 is illustrated in accordance with an example implementation of the invention. The top bearing is smaller in diameter or width than the bollard 104. Since it is made out of substance with a low coefficient of friction the door 102 resting with at least part of its weight on bearing 108.

Figure 7:
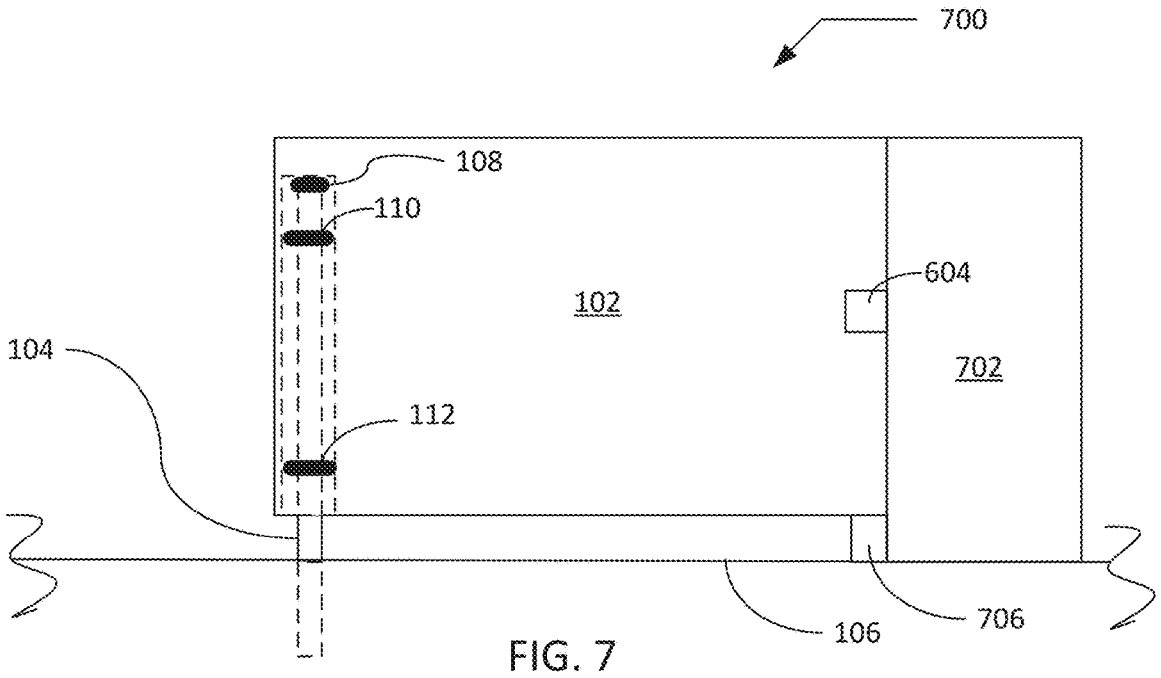
FIG. 7 illustrates the bollard and door of FIG. 1 in a closed position in accordance with an example implementation.

Turning to FIG. 7, the bollard 104 and door 102 of FIG. is depicted 700 in a closed position in accordance with an example implementation. The door 102 may have a latch 604 and door stop 706 that prevents the door from freely swinging around the bollard 104 in the current implementation. In other implementation, one or more doors may freely swing on the bollard 104 forming a turnstile. The door stop 706 may be attached to a wall or structure, such as wall 702.

Figure 5:
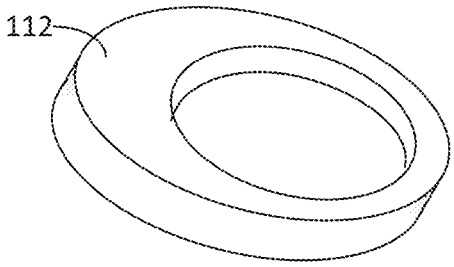
FIG. 5 illustrates a bottom bearing of the bollard of FIG. 2 in accordance with an example implementation of the invention.

Turning to FIG. 5, a bottom bearing 112 of bollard 104 of FIG. 2 is illustrated in accordance with an example implementation of the invention. The bottom bearing is not a perfect circle, rather it is elongated with a circular hole formed or cut off center. The material the upper bearing 110 is composed of is the same as the top bearing 108 of FIG. 3.

Referring back to FIG. 2, it is noted that the middle bearing 110 and bottom 112 bearing are positioned such that elongated portions of the bearings 110 and 112 oppose each other. When the door 102 is in a closed position, the door is actually angled in an upward angle and when opened upsweep in a downward motion due to the offset bearings 110 and 112. The advantage of such an arrangement is the sag that normally occurs with large bollard doors is negated by the door being angled in an upward angle. Furthermore, another advantage is ballords are not typically made to high tolerances and looseness caused by variances in ballords or wear can be absorbed by the bearings elongation and off center holes.

Figure 6:
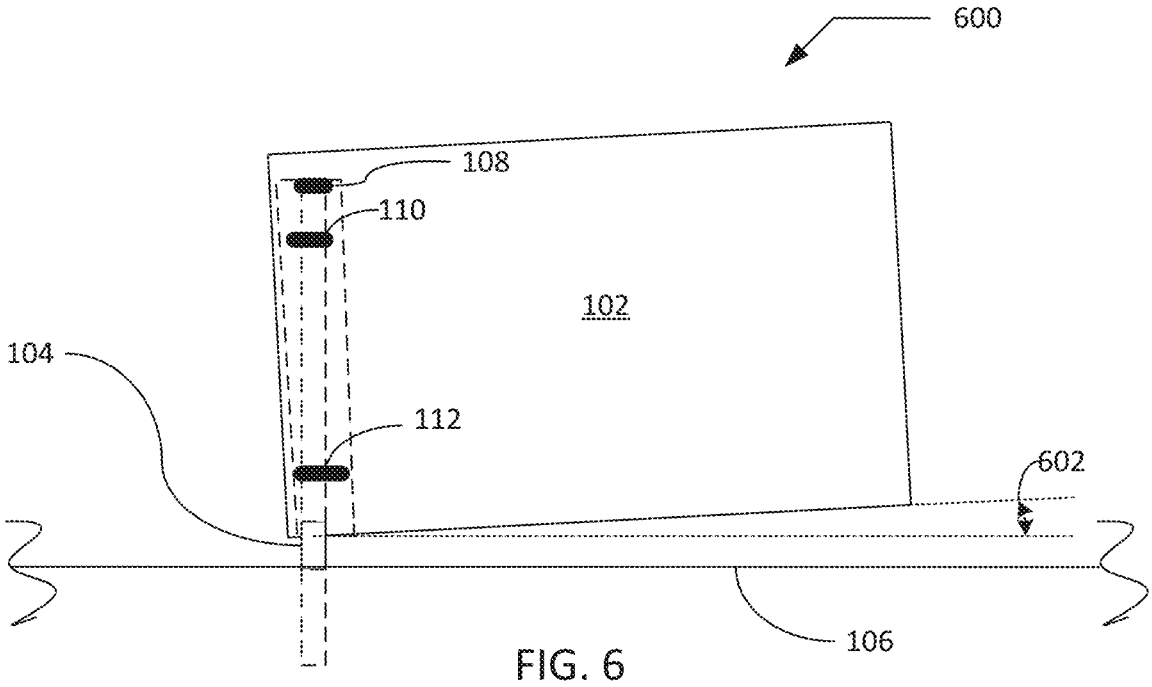
FIG. 6 illustrates the bollard and door of FIG. 1 in an open position in accordance with an example implementation.

In FIG. 6, the bollard 104 and door 102 of FIG. is illustrated 600 in an open position in accordance with an example implementation. When the door 102 is open, the offset holes in the upper bearing 110 and lower bearing 112 cause the door 102 to rise in the vertical plane 602 as it is turned. Such an arrangement of bearings prevents the door from dragging or sagging while swinging open and/or closed. Further, the door 102 is covering the majority of the bollard 104 and protecting it from the elements.

Turning to FIG. 7, the bollard 104 and door 102 of FIG. is depicted 700 in a closed position in accordance with an example implementation. The door 102 may have a latch 704 and door stop 706 that prevents the door from freely swinging around the bollard 104 in the current implementation. In other implementation, one or more doors may freely swing on the bollard 104 forming a turnstile. The door stop 706 may be attached to a wall or structure, such as wall 202.

Figure 8:
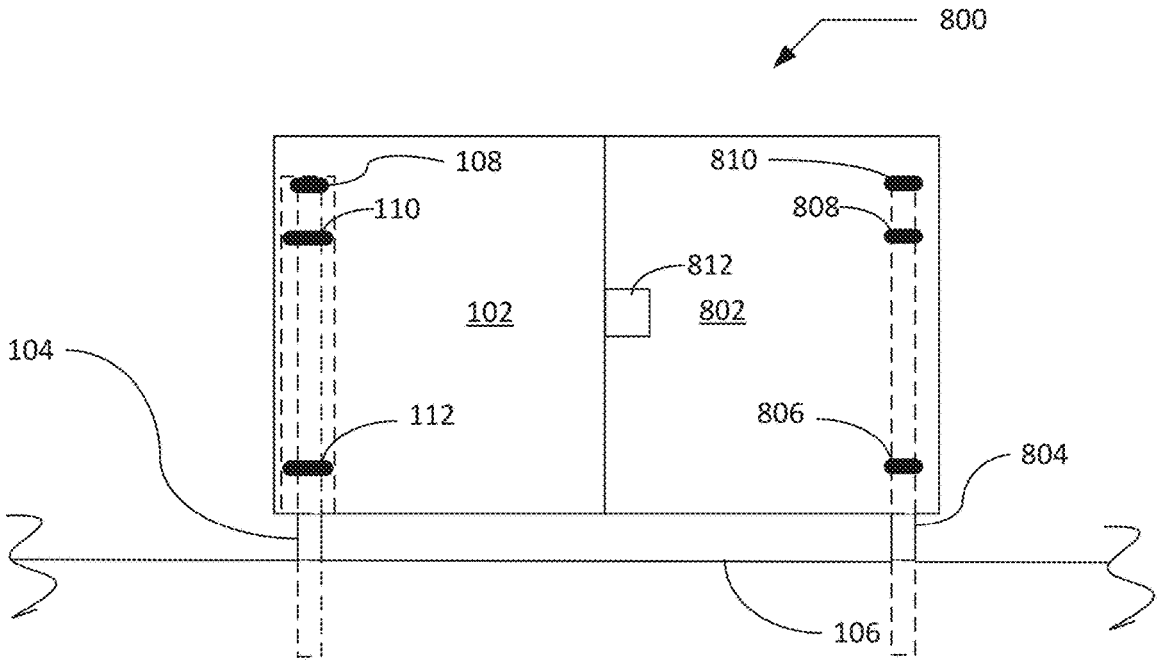
FIG. 8 illustrates the bollard and door of FIG. 1 with an additional door in accordance with an example implementation.

In FIG. 8, the bollard 104 and door 102 of FIG. 1 are illustrated 800 with an additional door 802 and additional bollard 804 in accordance with an example implementation. The bollard 804 has a top bearing 810, upper bearing 808 and lower bearing 806. Bollard 804 is shown secured in the ground 106 in a similar manner to bollard 104. The doors may be shaped to form a seal or otherwise latch using latch 812.

Figure 9B:
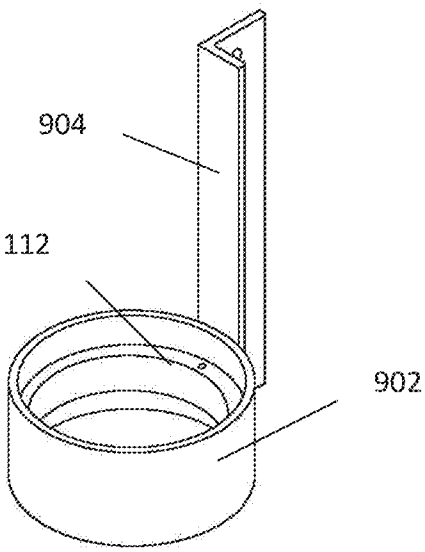
FIGS. 9*a-d* are illustrations a lower bracket having a lower bearing in accordance with another implementation of the invention.
Figure 9D:
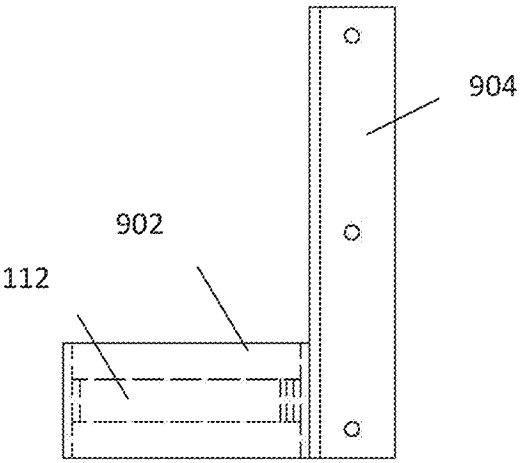
Figure 9A:
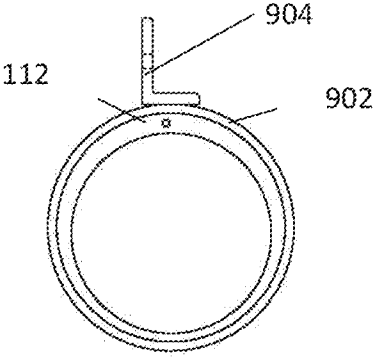
Figure 9C:
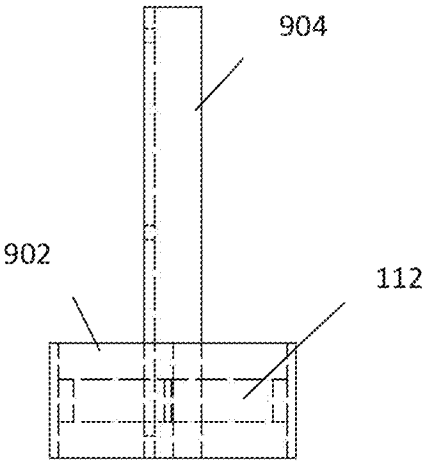
Figure 10A:
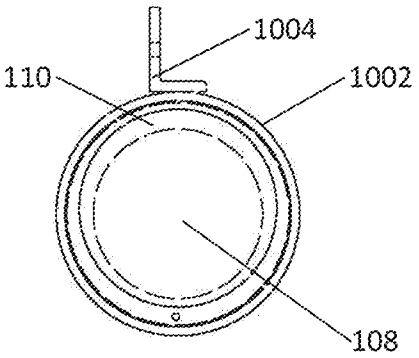
FIGS. 10*a-d* are illustrations of an upper bracket having a middle bearing and top bearing in accordance with another implementation of the invention.
Figure 10B:
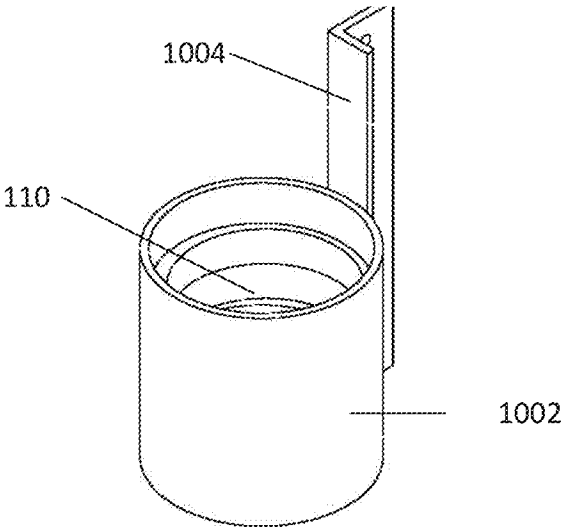
Figure 10C:
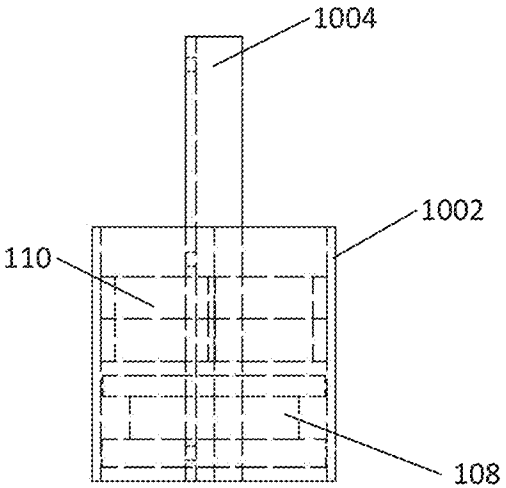
Figure 10D:
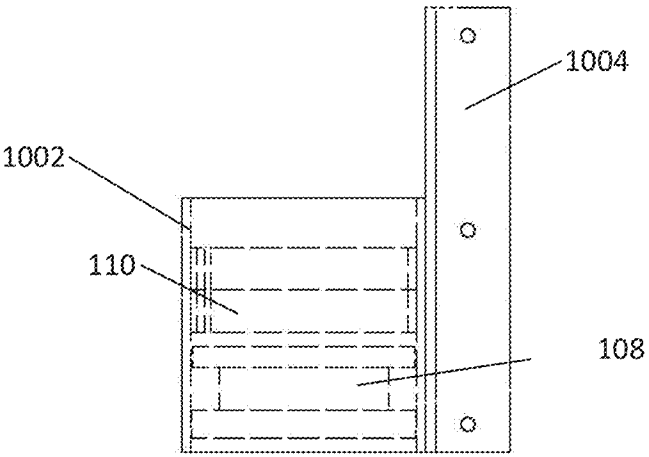

Turning to FIGS. 9*a-b*, a lower bracket 902 having the lower bearing 112 is illustrated in multiple views in accordance with another implementation of the invention. The lower (first) bracket 902 has a securing portion 904 for securing the bracket 902 to a door, such as door 102. In the current example, the securing portion 904 is an angled piece of metal that is welded to the lower bracket 902. In other implementations, the securing portion 904 may be formed or molded with the lower bracket 902. The lower bracket 902 is formed such that lower bearing is secured in the lower bracket and slides over a bollard, such as bollard 104. The door is attached with fasteners to the securing portion 904 and the lower bracket 902 turns with the door.

In FIG. 10*a-d*, an upper bracket 1002 with a middle bearing 110 and a top bearing 108 is illustrated in multiple views in accordance with another implementation of the invention. The upper (second) bracket 1002 has a securing portion 1004 for securing the upper bracket 1002 to a door, such as door 102. In the current example, the securing portion 1004 is an angled piece of metal that is welded to the upper bracket 1002. In other implementations, the securing portion 1004 may be formed or molded with the upper bracket 1002. The upper bracket 1002 is formed such that upper bearing 110 is secured in the upper bracket and slides over a bollard, such as bollard 104. The upper bracket 1002 is sealed at one end and encloses the top bearing 108 on the side surface and one of the planner surfaces. The other planner surface of the top bearing 108 supports the upper bracket 1002 on the bollard 104. An advantage of the upper bracket 1002 is that it covers the top of the bollard and protects it from the elements. The door is attached with fasteners to the securing portion 1004 and the upper bracket 1002 turns with the door.

Figure 11:
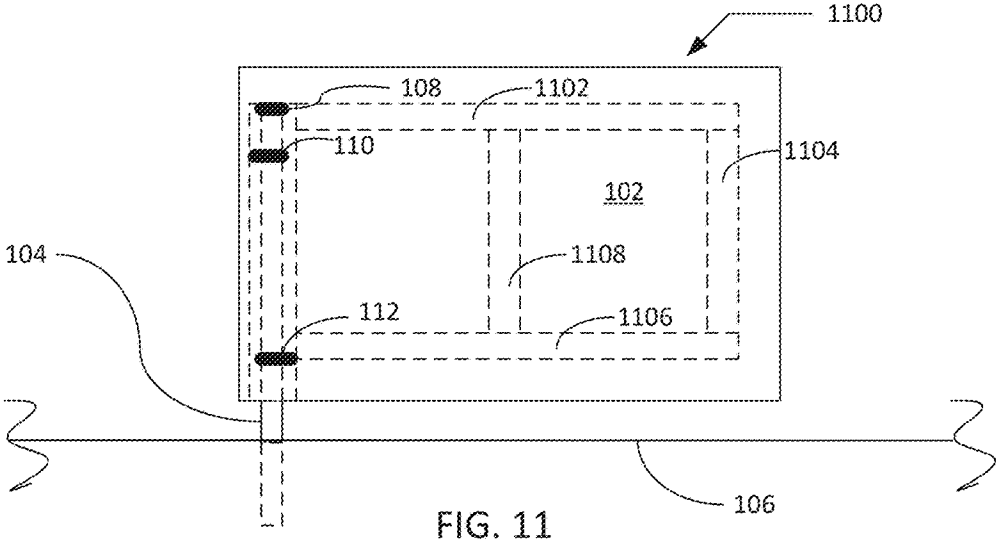
FIG. 11 is an illustration of the door with a metal frame and bollard of FIG. 1 in accordance with an example implementation of the invention.

Turning first to FIG. 11, an illustration 1100 of the door 102 and bollard mount of FIG. 1 with the door having an internal frame (rigid structure) 1102-1108 in accordance with an implementation is depicted. The bollard 104 must be strong enough to support the door 102 without moving. The bollard 104 support may come from embedding part of the bollard 104 in the ground 106, such as a hole formed from concrete. In other implementations, brackets secured to the ground or combination of bracket and hole may be used to support the bollard 104. The bollard 104 may support or have a plurality of bearings (108, 110 and 112) or devices that allow the door 102 to swing or otherwise move when the door 102 is placed over the bollard 104.

A frame made from a rigid structure such as metal, ceramic, plastic, wood, or plastic wood, etc. . . . is encased in the panel portion of the door. The rigid structure in the current embodiment is made from aluminum with the structural elements 1102-1108 welded together. The rigid structure in the current implementation is attached to the mount supported by the bollard 104 at securing portions 904 and 1004 of the bollard depicted in FIG. 9 and FIG. 10. The attachment of the rigid structure to the mount supported to the bollard 104 may be by welding or fasteners depending upon the implementation with welding being preferred. In the current implementation, the spaces between the rigid structure may be filled with a material such as foam. The foam may be solid with trenches formed for the rigid structure to sit in, injected into the door 102 in a semi-liquid form that hardens, or divided into sub-pieces that placed between the rigid structure members 1102-1108, to give but a few examples.

The advantage of encasing a rigid structure in the door 102 that is that the rigid structure is protected. The rigid structure also enables the bollard door to be lighter weight than traditional bollard doors. Known approaches for creating a bollard door typical uses panels that sandwich a supporting structure with fasteners, such that openings allow corrosion of the rigid structure to occur rather than a molding approach.

Figure 12:
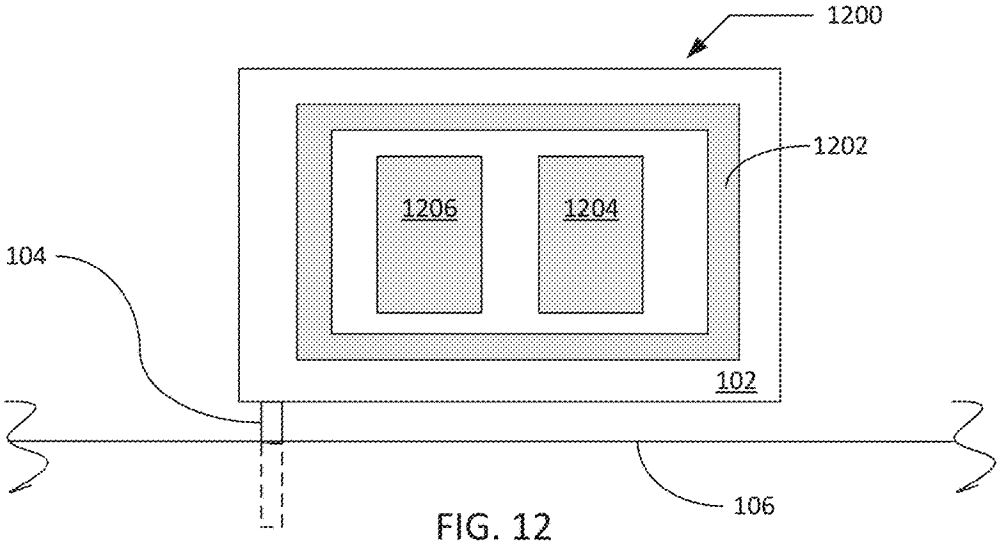
FIG. 12 is an illustration of the door of FIG. 11 decorated with associated decoration in accordance with an example implementation of the invention.

In FIG. 12, an illustration 1200 of the door of FIG. 11 decorated with associated decoration is depicted in accordance with an example implementation. The door 102 is a panel that encases a rigid structure 1102-1108 of FIG. 11. During the molding of the panel, decorative elements may be molded into the surface of the panel, such as decorative elements (decorative members) 1202-1206. The decorative elements may be formed in response to a molding process, such as injection molding. In the current implementation, the molding may be achieved with adding materials to the face of the panel that is then covered during the molding, such as a spray (or rotational) molding that coats the item it is sprayed on. The spray is typically a plastic type material The advantage of adding decorations to a panel in this approach is that holes for fasteners that could enable corrosion to occur are eliminated.

Thus, a lightweight door 102 having a protected rigid structure with enhanced resistance to corrosion and typical wear experienced by traditional bollard doors is achieved.

The foregoing description of an implementation has been presented for purposes of illustration and description. It is not exhaustive and does not limit the claimed inventions to the precise form disclosed. Modifications and variations are possible in light of the above description or may be acquired from practicing the invention. The claims and their equivalents define the scope of the invention.

What is claimed is:

1. A bollard door support that mounts on a bollard, comprising:

a first bracket having a lower bearing;

a second bracket having an upper bearing;

a rigid structure; and a door that encases the first bracket and the second bracket with the rigid structure secured to at least one of the first bracket or the second bracket, where the first bracket and the second bracket fit over the bollard and enable the first bracket and the second bracket to rotate on the bollard to move the door and the first bracket, the second bracket, and the rigid structure are located within the door, where the door is spray molded.

2. The bollard door support of claim 1, further comprising a top bearing located in the second bracket, where the top bearing is a solid bearing and supports the door and the first bracket and the second bracket.

3. The bollard door support of claim 2, where the top bearing is smaller than a hole formed by the lower bearing.

4. The bollard door support of claim 1, where the door is coupled to the first bracket and the second bracket with fasteners.

5. The bollard door support of claim 1, where the first bracket and the second bracket are integrated inside of the door.

6. The bollard door support of claim 1, where the lower bearing forms a hole that the bollard is able to fit through.

7. The bollard door support of claim 1, where the upper bearing forms a hole that the bollard is able to fit through.

8. The bollard door support of claim 2, where the top bearing is smaller than a hole formed by the upper bearing.

9. The bollard door support of claim 1, where the door includes decorations molded into a surface of the door.

10. The bollard door support of claim 1, where the door includes material between the rigid structure within the door.

* * * * *